US008553895B2

(12) United States Patent
Plogsties et al.

(10) Patent No.: US 8,553,895 B2
(45) Date of Patent: Oct. 8, 2013

(54) DEVICE AND METHOD FOR GENERATING AN ENCODED STEREO SIGNAL OF AN AUDIO PIECE OR AUDIO DATASTREAM

(75) Inventors: Jan Plogsties, Erlangen (DE); Harald Mundt, Erlangen (DE); Harald Popp, Tuchenbach (DE)

(73) Assignee: Fraunhofer-Gesellschaft zur Foerderung der Angewandten Forschung e.V., Munich (DE)

( * ) Notice: Subject to any disclaimer, the term of this patent is extended or adjusted under 35 U.S.C. 154(b) by 1777 days.

(21) Appl. No.: 11/840,273

(22) Filed: Aug. 17, 2007

(65) Prior Publication Data

US 2007/0297616 A1 Dec. 27, 2007

Related U.S. Application Data

(63) Continuation of application No. PCT/EP2006/001622, filed on Feb. 22, 2006.

(30) Foreign Application Priority Data

Mar. 4, 2005 (DE) ..... 10 2005 010 057

(51) Int. Cl.
*H04R 5/00* (2006.01)

(52) U.S. Cl.
USPC ..... 381/23; 381/17; 381/310; 381/300; 381/306; 381/309; 381/312; 700/94; 704/500; 704/501

(58) Field of Classification Search
USPC ..... 381/310, 300, 306, 23, 17, 309, 312, 381/313, 317, 323; 700/94; 704/500, 501
See application file for complete search history.

(56) References Cited

U.S. PATENT DOCUMENTS

| | | | | |
|---|---|---|---|---|
| 5,488,665 | A | 1/1996 | Johnston et al. | |
| 5,491,754 | A | 2/1996 | Jot et al. | |
| 5,632,005 | A | 5/1997 | Davis et al. | |
| 5,659,619 | A * | 8/1997 | Abel | 381/17 |

(Continued)

FOREIGN PATENT DOCUMENTS

| | | | |
|---|---|---|---|
| CN | 1212580 | A | 3/1999 |
| CN | 1469684 | A | 1/2004 |

(Continued)

OTHER PUBLICATIONS

Takamizawa et al , High-Quality and Processor-Efficient Implementation of an MPEG-2 AAC Encoder, 2001,IEEE,pp. 985-988.*

(Continued)

*Primary Examiner* — Mohammad Islam
*Assistant Examiner* — Kuassi Ganmavo
(74) *Attorney, Agent, or Firm* — Keating & Bennett, LLP

(57) ABSTRACT

A device for generating an encoded stereo signal from a multi-channel representation includes a multi-channel decoder generating three of more multi-channels from at least one basic channel and parametric information. The three or more multi-channels are subjected to headphone signal processing to generate an uncoded first stereo channel and an uncoded second stereo channel which are then supplied to a stereo encoder to generate an encoded stereo file on the output side. The encoded stereo file may be supplied to any suitable player in the form of a CD player or a hardware player such that a user of the player does not only get a normal stereo impression but a multi-channel impression.

9 Claims, 7 Drawing Sheets

(56) References Cited

U.S. PATENT DOCUMENTS

| | | | | |
|---|---|---|---|---|
| 5,703,999 | A | 12/1997 | Herre et al. | |
| 5,706,309 | A | 1/1998 | Eberlein et al. | |
| 5,742,689 | A * | 4/1998 | Tucker et al. | 381/17 |
| 5,812,971 | A * | 9/1998 | Herre | 704/230 |
| 5,982,903 | A * | 11/1999 | Kinoshita et al. | 381/18 |
| 6,023,490 | A | 2/2000 | Ten Kate | |
| 6,741,706 | B1 * | 5/2004 | McGrath et al. | 381/22 |
| 6,766,028 | B1 * | 7/2004 | Dickens | 381/310 |
| 7,394,903 | B2 * | 7/2008 | Herre et al. | 381/23 |
| 7,447,629 | B2 * | 11/2008 | Breebaart | 704/219 |
| 7,949,141 | B2 * | 5/2011 | Reilly et al. | 381/63 |
| 2002/0038158 | A1 | 3/2002 | Hashimoto et al. | |
| 2003/0026441 | A1 | 2/2003 | Faller | |
| 2003/0035553 | A1 | 2/2003 | Baumgarte et al. | |
| 2003/0219130 | A1 | 11/2003 | Baumgarte et al. | |
| 2004/0008847 | A1 | 1/2004 | Kim | |
| 2005/0273324 | A1 * | 12/2005 | Yi | 704/226 |
| 2005/0276430 | A1 * | 12/2005 | He et al. | 381/309 |
| 2008/0052089 | A1 * | 2/2008 | Takagi | 704/503 |

FOREIGN PATENT DOCUMENTS

| | | | | |
|---|---|---|---|---|
| EP | 1 768 451 | A1 | | 3/2007 |
| JP | 06-043890 | A | | 2/1994 |
| JP | 06-269097 | A | | 9/1994 |
| JP | 09-500252 | A | | 1/1997 |
| JP | 2001-100792 | A | | 4/2001 |
| JP | 2001-255892 | A | | 9/2001 |
| JP | 2001-331198 | A | | 11/2001 |
| JP | 2002-191099 | A | | 7/2002 |
| JP | 04-240896 | | | 8/2002 |
| JP | 2002-262385 | A | | 9/2002 |
| JP | 2003-009296 | A | | 1/2003 |
| JP | 2003-522441 | A | | 7/2003 |
| JP | 2004170610 | A | * | 6/2004 |
| JP | 2004-246224 | A | | 9/2004 |
| KR | 1020040027015 | A | * | 1/2004 |
| KR | 10-2004-0027015 | | * | 4/2004 |
| WO | 94/01933 | A1 | | 1/1994 |
| WO | 95/16333 | A1 | | 6/1995 |
| WO | 99/14983 | A1 | | 3/1999 |
| WO | 99/49574 | A1 | | 9/1999 |
| WO | 01/05074 | A2 | | 1/2001 |
| WO | 03/086017 | A2 | | 10/2003 |
| WO | 03/090207 | A1 | | 10/2003 |

OTHER PUBLICATIONS

Durand R. Begault, Perceptual Effects of Synthetic Reverberation on Three-Dimensional Audio Systems, Nov. 1992,J. Audio Eng.Soc., vol. 40,No. 11,pp. 895-903.*

U.S. Appl. No. 60/578,717, filed Jun. 2004, Yi Kyueun.*

English language translation of Official Communication issued in corresponding Japanese Patent Application No. 2007-557373, mailed on Jul. 13, 2010.

English translation of the official communication issued in counterpart International Application No. PCT/EP2006/001622, mailed on Jan. 31, 2008.

Official communication issued in counterpart European Application No. 06 707 184.5, mailed on Nov. 3, 2008.

Official Communication issued in corresponding Taiwanese Patent Application No. 95106978, mailed on Sep. 23, 2009.

English translation of the official communication issued in counterpart Taiwanese Application No. 95106978, mailed on Apr. 27, 2009.

Official communication issued in the counterpart International Application No. PCT/EP2006/001622, mailed on Aug. 18, 2006.

Herre et al., "MP3 Surround: Efficient and Compatible Coding of Multi-Channel Audio"; Audio Engineering Society Convention Paper 6049, 116th Convention; Berlin, Germany; pp. 1-14; May 8-11, 2004.

Faller et al., "Binaural Cue Coding Applied to Stereo and Multi-Channel Audio Compression"; Audio Engineering Society Convention Paper 5574, 112th Convention; Munich, Germany; pp. 1-9; May 10-13, 2002.

Herre et al., "Intensity Stereo Coding"; Preprints of Papers Presented at the AES Convention, Amsterdam, pp. 1-10; Feb. 26-Mar. 1, 1994.

Herre et al., "Spatial Audio Coding: Next-generation Efficient and Compatible Coding of Multi-Channel Audio"; Audio Engineering Society Convention Paper 6186, 117th Convention; San Francisco, CA; pp. 1-13; Oct. 28-31, 2004.

Faller, "Coding of Spatial Audio Compatible with Different Playback Formats"; Audio Engineering Society Convention Paper, 117th Convention; San Francisco, CA; pp. 1-12; Oct. 28-31, 2004.

Faller et al., "Binaural Cue Coding: Part II: Schemes and Applications", 2003 IEEE Transactions on Speech and Audio Processing; vol. 11, No. 6; pp. 520-531; Nov. 2003.

Official Communication issued in corresponding Japanese Patent Application No. 2007-557373, mailed on May 10, 2011.

* cited by examiner

DEVICE AND METHOD FOR GENERATING AN ENCODED STEREO SIGNAL OF AN AUDIO PIECE OR AUDIO DATASTREAM

CROSS-REFERENCE TO RELATED APPLICATIONS

This application is a continuation of copending International Application No. PCT/EP2006/001622, filed Feb. 22, 2006, which designated the United States and was not published in English.

BACKGROUND OF THE INVENTION

1. Field of the Invention

The present invention relates to multi-channel audio technology and, in particular, to multi-channel audio applications in connection with headphone technologies.

2. Description of the Related Art

The international patent applications WO 99/49574 and WO 99/14983 disclose audio signal processing technologies for driving a pair of oppositely arranged headphone loudspeakers in order for a user to get a spatial perception of the audio scene via the two headphones, which is not only a stereo representation but a multi-channel representation. Thus, the listener will get, via his or her headphones, a spatial perception of an audio piece which in the best case equals his or her spatial perception, should the user be sitting in a reproduction room which is exemplarily equipped with a 5.1 audio system. For this purpose, for each headphone loudspeaker, each channel of the multi-channel audio piece or the multi-channel audio datastream, as is illustrated in FIG. 2, is supplied to a separate filter, whereupon the respective filtered channels belonging together are added, as will be illustrated subsequently.

On a left side in FIG. 2, there are the multi-channel inputs 20 which together represent a multi-channel representation of the audio piece or the audio datastream. Such a scenario is exemplarily schematically shown in FIG. 10. FIG. 10 shows a reproduction space 200 in which a so-called 5.1 audio system is arranged. The 5.1 audio system includes a center loudspeaker 201, a front-left loudspeaker 202, a front-right loudspeaker 203, a back-left loudspeaker 204 and a back-right loudspeaker 205. A 5.1 audio system comprises an additional subwoofer 206 which is also referred to as low-frequency enhancement channel. In the so-called "sweet spot" of the reproduction space 200, there is a listener 207 wearing a headphone 208 comprising a left headphone loudspeaker 209 and a right headphone loudspeaker 210.

The processing means shown in FIG. 2 is formed to filter each channel 1, 2, 3 of the multi-channel inputs 20 by a filter $H_{iL}$ describing the sound channel from the loudspeaker to the left loudspeaker 209 in FIG. 10 and to additionally filter the same channel by a filter $H_{iR}$ representing the sound from one of the five loudspeakers to the right ear or the right loudspeaker 210 of the headphone 208.

If, for example, channel 1 in FIG. 2 were the front-left channel emitted by the loudspeaker 202 in FIG. 10, the filter $H_{iL}$ would represent the channel indicated by a broken line 212, whereas the filter $H_{iR}$ would represent the channel indicated by a broken line 213. As is exemplarily indicated in FIG. 10 by a broken line 214, the left headphone loudspeaker 209 does not only receive the direct sound, but also early reflections at an edge of the reproduction space and, of course, also late reflections expressed in a diffuse reverberation.

Such a filter representation is illustrated in FIG. 11. In particular, FIG. 11 shows a schematic example of an impulse response of a filter, such as, for example, of the filter $H_{iL}$ of FIG. 2. The direct or primary sound illustrated in FIG. 11 by the line 212 is represented by a peak at the beginning of the filter, whereas early reflections, as are illustrated exemplarily in FIG. 10 by 214, are reproduced by a center region having several (discrete) small peaks in FIG. 11. The diffuse reverberation is typically no longer resolved for individual peaks, since the sound of the loudspeaker 202 in principle is reflected arbitrarily frequently, wherein the energy of course decreases with each reflection and additional propagation distance, as is illustrated by the decreasing energy in the back portion which in FIG. 11 is referred to as "diffuse reverberation".

Each filter shown in FIG. 2 thus includes a filter impulse response roughly having a profile as is shown by the schematic impulse response illustration of FIG. 11. It is obvious that the individual filter impulse response will depend on the reproduction space, the positioning of the loudspeakers, possible attenuation features in the reproduction space, for example due to several persons present or due to furniture in the reproduction space, and ideally also on the characteristics of the individual loudspeakers 201 to 206.

The fact that the signals of all loudspeakers are superposed at the ear of the listener 207 is illustrated by the adders 22 and 23 in FIG. 2. Thus, each channel is filtered by a corresponding filter for the left ear to then simply add up the signals output by the filters which are destined for the left ear to obtain the headphone output signal for the left ear L. In analogy, an addition by the adder 23 for the right ear or the right headphone loudspeaker 210 in FIG. 10 is performed to obtain the headphone output signal for the right ear by superposing all the loudspeaker signals filtered by a corresponding filter for the right ear.

Due to the fact that, apart from the direct sound, there are also early reflections and, in particular, a diffuse reverberation, which is of particularly high importance for the space perception, in order for the tone not to sound synthetic or "awkward" but to give the listener the impression that he or she is actually sitting in a concert room with its acoustic characteristics, impulse responses of the individual filters 21 will all be of considerable lengths. The convolution of each individual multi-channel of the multi-channel representation having two filters already results in a considerable computing task. Since two filters are necessary for each individual multi-channel, namely one for the left ear and another one for the right ear, when the subwoofer channel is also treated separately, a total amount of 12 completely different filters is necessary for a headphone reproduction of a 5.1 multi-channel representation. All filters have, as becomes obvious from FIG. 11, a very long impulse response to be able to not only consider the direct sound but also early reflections and the diffuse reverberation, which really only gives an audio piece the proper sound reproduction and a good spatial impression.

In order to put the well-known concept into practice, apart from a multi-channel player 220, as is shown in FIG. 10, very complicated virtual sound processing 222 is necessary, which provides the signals for the two loudspeakers 209 and 210 represented by lines 224 and 226 in FIG. 10.

Headphone systems for generating a multi-channel headphone sound are complicated, bulky and expensive, which is due to the high computing power, the high current requirement for the high computing power necessary and the high working memory requirements for the evaluations to be performed of the impulse response and the high volume or expensive elements for the player connected thereto. Applications of this kind are thus tied to home PC sound cards or laptop sound cards or home stereo systems.

In particular, the multi-channel headphone sound remains inaccessible for the continually increasing market of mobile players, such as, for example, mobile CD players, or, in particular, hardware players, since the calculating requirements for filtering the multi-channels with exemplarily 12 different filters cannot be realized in this price segment neither with regard to the processor resources nor with regard to the current requirements of typically battery-driven apparatuses. This refers to a price segment at the bottom (lower) end of the scale. However, this very price segment is economically very interesting due to the high numbers of pieces.

SUMMARY OF THE INVENTION

According to an embodiment, a device for generating an encoded stereo signal of an audio piece or an audio datastream having a first stereo channel and a second stereo channel from a multi-channel representation of the audio piece or the audio datastream having information on more than two multi-channels, may have: means for providing the more than two multi-channels from the multi-channel representation; means for performing headphone signal processing to generate an uncoded stereo signal with an uncoded first stereo channel and an uncoded second stereo channel, the means for performing being formed to evaluate each multi-channel by a first filter function derived from a virtual position of a loudspeaker for reproducing the multi-channel and a virtual first ear position of a listener, for the first stereo channel, and a second filter function derived from a virtual position of the loudspeaker and a virtual second ear position of the listener, for the second stereo channel, to generate a first evaluated channel and a second evaluated channel for each multi-channel, the two virtual ear positions of the listener being different, to add the evaluated first channels to obtain the uncoded first stereo channel, and to add the evaluated second channels to obtain the uncoded second stereo channel; and a stereo encoder for encoding the uncoded first stereo channel and the uncoded second stereo channel to obtain the encoded stereo signal, the stereo encoder being formed such that a data rate necessary for transmitting the encoded stereo signal is smaller than a data rate necessary for transmitting the uncoded stereo signal.

According to another embodiment, a method for generating an encoded stereo signal of an audio piece or an audio datastream having a first stereo channel and a second stereo channel from a multi-channel representation of the audio piece or the audio datastream having information on more than two multi-channels, may have the steps of: providing the more than two multi-channels from the multi-channel representation; performing headphone signal processing to generate an uncoded stereo signal with an uncoded first stereo channel and an uncoded second stereo channel, the step of performing having: evaluating each multi-channel by a first filter function derived from a virtual position of a loudspeaker for reproducing the multi-channel and a virtual first ear position of a listener, for the first stereo channel, and a second filter function derived from a virtual position of the loudspeaker and a virtual second ear position of the listener, for the second stereo channel, to generate a first evaluated channel and a second evaluated channel for each multi-channel, the two virtual ear positions of the listener being different, adding the evaluated first channels to obtain the uncoded first stereo channel, and adding the evaluated second channels to obtain the uncoded second stereo channel; and stereo-coding the uncoded first stereo channel and the uncoded second stereo channel to obtain the encoded stereo signal, the step of stereo-coding being executed such that a data rate necessary for transmitting the encoded stereo signal is smaller than a data rate necessary for transmitting the uncoded stereo signal.

An embodiment may have a computer program having a program code for performing the method for generating an encoded stereo signal mentioned above, when the computer program runs on a computer.

Embodiments of the present invention are based on the finding that the high-quality and attractive multi-channel headphone sound can be made available to all players available, such as, for example, CD players or hardware players, by subjecting a multi-channel representation of an audio piece or audio datastream, i.e. exemplarily a 5.1 representation of an audio piece, to headphone signal processing outside a hardware player, i.e. exemplarily in a computer of a provider having a high calculating power. According to an embodiment of the invention, the result of a headphone signal processing is, however, not simply played but supplied to a typical audio stereo encoder which then generates an encoded stereo signal from the left headphone channel and the right headphone channel.

This encoded stereo signal may then, like any other encoded stereo signal not comprising a multi-channel representation, be supplied to the hardware player or, for example, a mobile CD player in the form of a CD. The reproduction or replay apparatus will then provide the user with a headphone multi-channel sound without any additional resources or means having to be added to devices already existing. Inventively, the result of the headphone signal processing, i.e. the left and the right headphone signal, is not reproduced in a headphone, as has been the case so far, but encoded and output as encoded stereo data.

Such an output may be storage, transmission or the like. Such a file having encoded stereo data may then easily be supplied to any reproduction device designed for stereo reproduction, without the user having to perform any changes on his device.

The inventive concept of generating an encoded stereo signal from the result of the headphone signal processing thus allows multi-channel representation providing a considerably improved and more real quality for the user, to be also employed on all simple and widespread and, in future, even more widespread hardware players.

In an embodiment of the present invention, the starting point is an encoded multi-channel representation, i.e. a parametric representation comprising one or typically two basic channels and additionally comprising parametric data to generate the multi-channels of the multi-channel representation on the basis of the basic channels and the parametric data. Since a frequency domain-based method for multi-channel decoding is of advantage, the headphone signal processing is, according to an embodiment of the invention, not performed in the time domain by convoluting the time signal by an impulse response, but in the frequency domain by multiplication by the filter transmission function.

This allows at least one retransformation before the headphone signal processing to be saved and is of particular advantage when the subsequent stereo encoder also operates in the frequency domain, such that the stereo encoding of the headphone stereo signal, without ever having to go to the time domain, may also take place without going to the time domain. The processing from the multi-channel representation to the encoded stereo signal, without the time domain taking part or by an at least reduced number of transformations, is interesting not only with regard to the calculating time efficiency, but puts a limit to quality losses since fewer processing stages will introduce fewer artefacts into the audio signal.

In particular in block-based methods performing quantization considering a psycho-acoustic masking threshold, as is of advantage for the stereo encoder, it is important to prevent as may tandem encoding artefacts as possible.

In an embodiment of the present invention, a BCC representation having one or advantageously two basic channels is used as a multi-channel representation. Since the BCC method operates in the frequency domain, the multi-channels are not transformed to the time domain after synthesis, as is usually done in a BCC decoder. Instead, the spectral representation of the multi-channels in the form of blocks is used and subjected to the headphone signal processing. For this, the transformation functions of the filters, i.e. the Fourier transforms of the impulse responses, are used to perform a multiplication of the spectral representation of the multi-channels by the filter transformation functions. When the impulse responses of the filters are, in time, longer than a block of spectral components at the output of the BCC decoder, a block-wise filter processing is of advantage where the impulse responses of the filters are separated in the time domain and are transformed block by block in order to then perform corresponding spectrum weightings necessary for measures of this kind, as is, for example, disclosed in WO 94/01933.

Other features, elements, processes, steps, characteristics and advantages of the present invention will become more apparent from the following detailed description of preferred embodiments of the present invention with reference to the attached drawings.

BRIEF DESCRIPTION OF THE DRAWINGS

Embodiments of the present invention will be detailed subsequently referring to the appended drawings, in which.

DETAILED DESCRIPTION OF PREFERRED EMBODIMENTS

Figure 1:
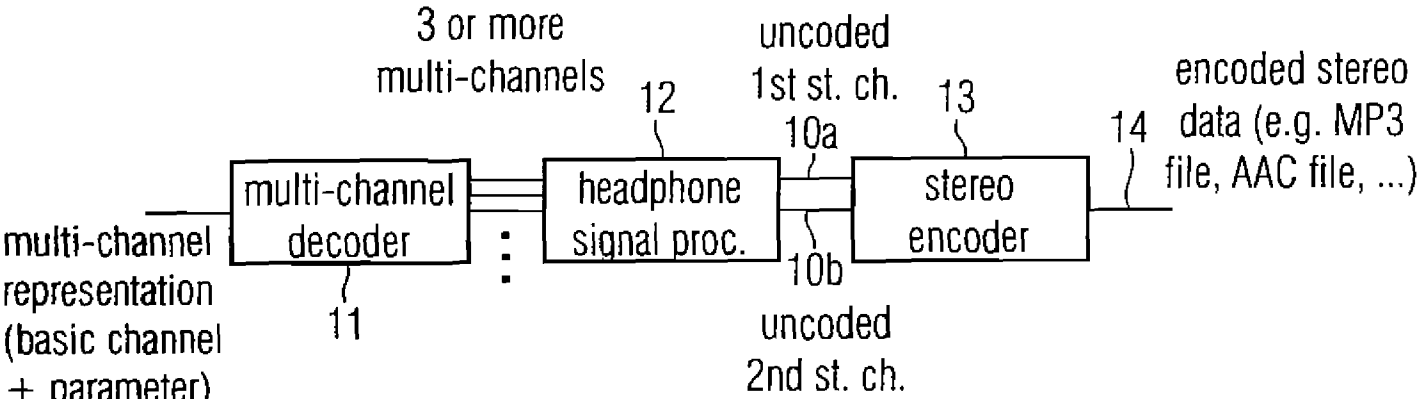
FIG. 1 shows a block circuit diagram of the inventive device for generating an encoded stereo signal.

FIG. 1 shows a principle block circuit diagram of an inventive device for generating an encoded stereo signal of an audio piece or an audio datastream. The stereo signal includes, in an uncoded form, an uncoded first stereo channel 10*a* and an uncoded second stereo channel 10*b* and is generated from a multi-channel representation of the audio piece or the audio data stream, wherein the multi-channel representation comprises information on more than two multi-channels. As will be explained later, the multi-channel representation may be in an uncoded or an encoded form. If the multi-channel representation is in an uncoded form, it will include three or more multi-channels. With an application scenario, the multi-channel representation includes five channels and one subwoofer channel.

If the multi-channel representation is, however, in an encoded form, this encoded form will typically include one or several basic channels as well as parameters for synthesizing the three or more multi-channels from the one or two basic channels. A multi-channel decoder 11 thus is an example of means for providing the more than two multi-channels from the multi-channel representation. If the multi-channel representation is, however, already in an uncoded form, i.e., for example, in the form of 5+1 PCM channels, the means for providing corresponds to an input terminal for means 12 for performing headphone signal processing to generate the uncoded stereo signal with the uncoded first stereo channel 10*a* and the uncoded second stereo channel 10*b*.

Figure 2:
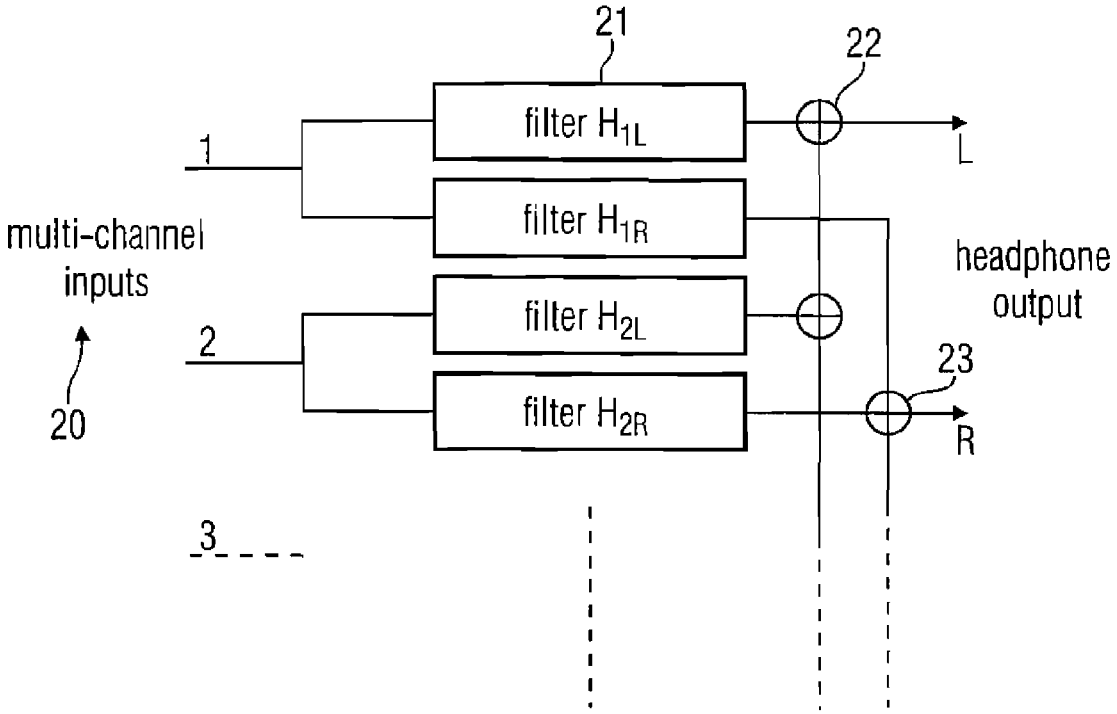
FIG. 2 is a detailed illustration of an implementation of the headphone signal processing of FIG. 1.

Advantageously, the means 12 for performing headphone signal processing is formed to evaluate the multi-channels of the multi-channel representation each by a first filter function for the first stereo channel and by a second filter function for the second stereo channel and to add the respective evaluated multi-channels to obtain the uncoded first stereo channel and the uncoded second stereo channel, as is illustrated referring to FIG. 2. Downstream of the means 12 for performing the headphone signal processing is a stereo encoder 13 which is formed to encode the first uncoded stereo channel 10*a* and the second uncoded stereo channel 10*b* to obtain the encoded stereo signal at an output 14 of the stereo encoder 13. The stereo encoder performs a data rate reduction such that a data rate necessary for transmitting the encoded stereo signal is smaller than a data rate necessary for transmitting the uncoded stereo signal.

According to the invention, a concept is achieved which allows supplying a multi-channel tone, which is also referred to as "surround", to stereo headphones via simple players, such as, for example, hardware players.

The sum of certain channels may exemplarily be formed as simple headphone signal processing to obtain the output channels for the stereo data. Improved methods operate with more complex algorithms which in turn obtain an improved reproduction quality.

It is to be mentioned that the inventive concept allows the calculating-intense steps for multi-channel decoding and for performing the headphone signal processing not to be performed in the player itself but to be performed externally. The result of the inventive concept is an encoded stereo file which is, for example, an MP3 file, an AAC file, an HE-AAC file or some other stereo file.

In other embodiments, the multi-channel decoding, headphone signal processing and stereo encoding may be performed on different devices since the output data and input data, respectively, of the individual blocks may be ported easily and be generated and stored in a standardized way.

Figure 7:
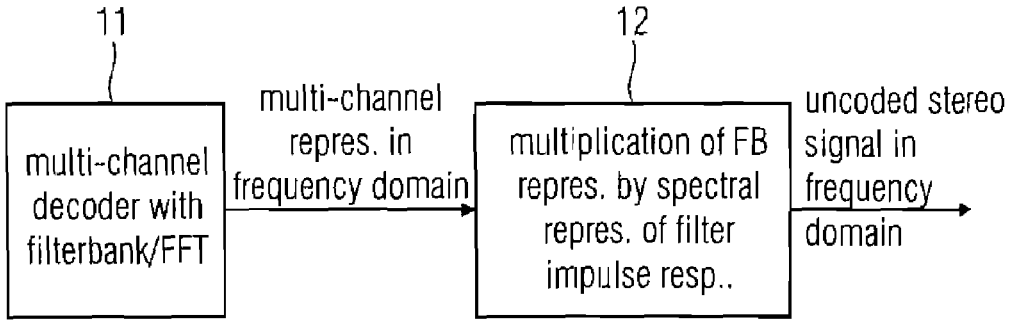
FIG. 7 shows cascading between a multi-channel decoder and the headphone signal processing without any transformation to the time domain.

Subsequently, reference will be made to FIG. 7 showing an embodiment of the present invention where the multi-channel decoder 11 comprises a filter bank or FFT function such that the multi-channel representation is provided in the frequency domain. In particular, the individual multi-channels are generated as blocks of spectral values for each channel. Inventively, the headphone signal processing is not performed in the time domain by convoluting the temporal channels with the filter impulse responses, but a multiplication of the frequency domain representation of the multi-channels by a spectral representation of the filter impulse response is performed. An uncoded stereo signal is achieved at the output of the headphone signal processing, which is, however, not in the time domain but includes a left and a right stereo channel, wherein such a stereo channel is given as a sequence of blocks of spectral values, each block of spectral values representing a short-term spectrum of the stereo channel.

Figure 8:
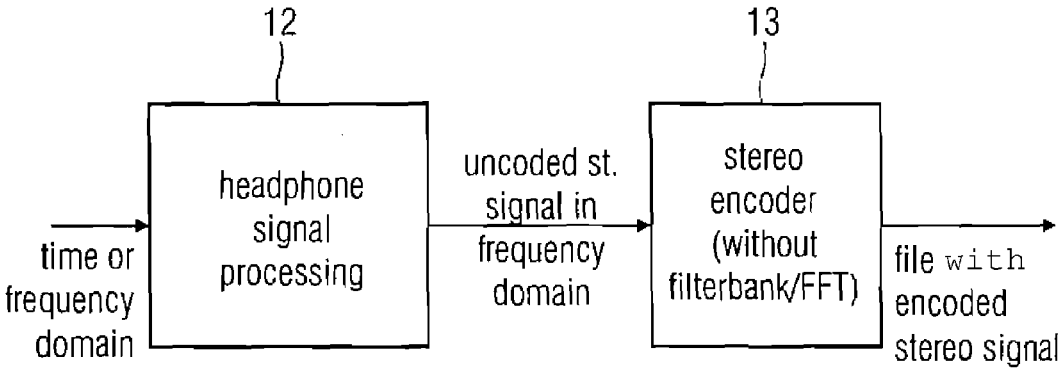
FIG. 8 shows cascading between the headphone signal processing and a stereo encoder without any transformation to the time domain.

In the embodiment shown in FIG. 8, the headphone signal-processing block 12 is, on the input side, supplied with either time-domain or frequency-domain data. On the output side, the uncoded stereo channels are generated in the frequency domain, i.e. again as a sequence of blocks of spectral values. A stereo encoder which is based on a transformation, i.e. which processes spectral values without a frequency/time conversion and a subsequent time/frequency conversion being necessary between the headphone signal processing 12 and the stereo encoder 13, is of advantage as the stereo encoder 13 in this case. On the output side, the stereo encoder 13 then outputs a file with the encoded stereo signal which, apart from side information, includes an encoded form of spectral values.

In an embodiment of the present invention, a continuous frequency domain processing is performed on the way from the multi-channel representation at the input of block 11 of FIG. 1 to the encoded stereo file at the output 14 of the means of FIG. 1, without a transformation to the time domain and, possibly, a re-transformation to the frequency domain having to take place. When an MP3 encoder or an AAC encoder is used as the stereo encoder, it will be of advantage to transform the Fourier spectrum at the output of the headphone signal-processing block to an MDCT spectrum. Thus, it is ensured according to the invention that the phase information necessary in a precise form for the convolution/evaluation of the channels in the headphone signal-processing block is converted to the MDCT representation not operating in such a phase-correct way, such that means for transforming from the time domain to the frequency domain, i.e. to the MDCT spectrum, is not necessary for the stereo encoder, in contrast to a normal MP3 encoder or a normal AAC encoder.

Figure 9:
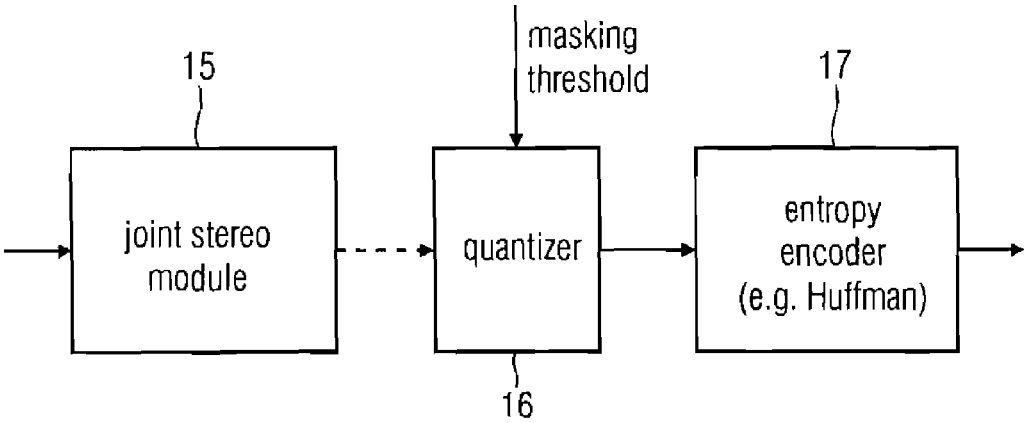
FIG. 9 shows a principle block diagram of a stereo encoder.
Figure 10:
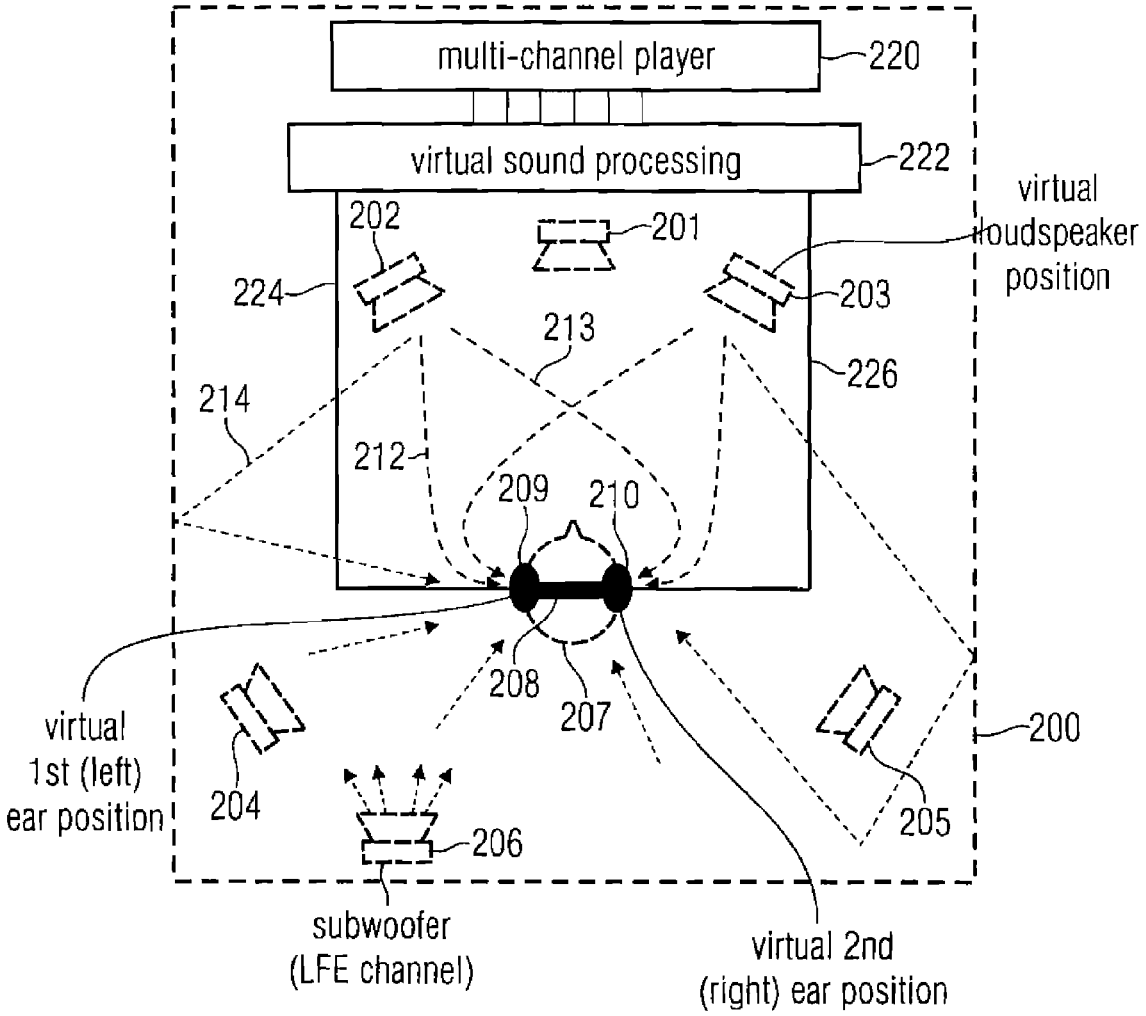
FIG. 10 is a principle illustration of a reproduction scenario for determining the filter functions of FIG. 2.
Figure 11:
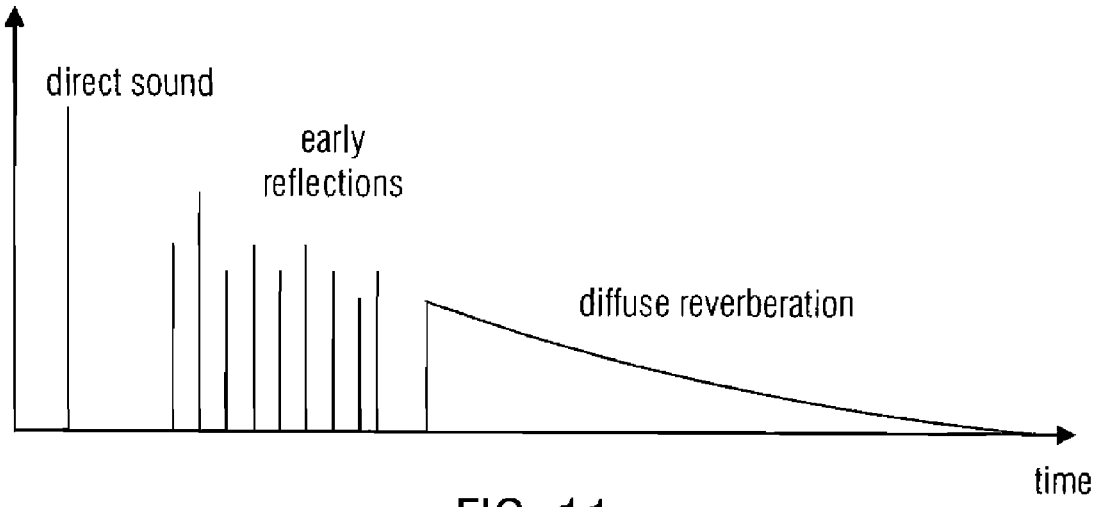
FIG. 11 is a principle illustration of an expected impulse response of a filter determined according to FIG. 10.

FIG. 9 shows a general block circuit diagram for a stereo encoder. The stereo encoder includes, on the input side, a joint stereo module 15 which is determining in an adaptive way whether a common stereo encoding, for example in the form of a center/side encoding, provides a higher encoding gain than a separate processing of the left and right channels. The joint stereo module 15 may further be formed to perform an intensity stereo encoding, wherein an intensity stereo encoding, in particular with higher frequencies, provides a considerable encoding gain without audible artefacts arising. The output of the joint stereo module 15 is then processed further using different other redundancy-reducing measures, such as, for example, TNS filtering, noise substitution, etc., to then supply the results to a quantizer 16 which achieves a quantization of the spectral values using a psycho-acoustic masking threshold. The quantizer step size here is selected such that the noise introduced by quantizing remains below the psycho-acoustic masking threshold, such that a data rate reduction is achieved without the distortions introduced by the lossy quantization to be audible. Downstream of the quantizer 16, there is an entropy encoder 17 performing lossless entropy encoding of the quantized spectral values. At the output of the entropy encoder, there is the encoded stereo signal which, apart from the entropy-coded spectral values, includes side information necessary for decoding.

Subsequently, reference will be made to implementations of the multi-channel decoder and to multi-channel illustrations using FIGS. 3 to 6.

Figure 3:
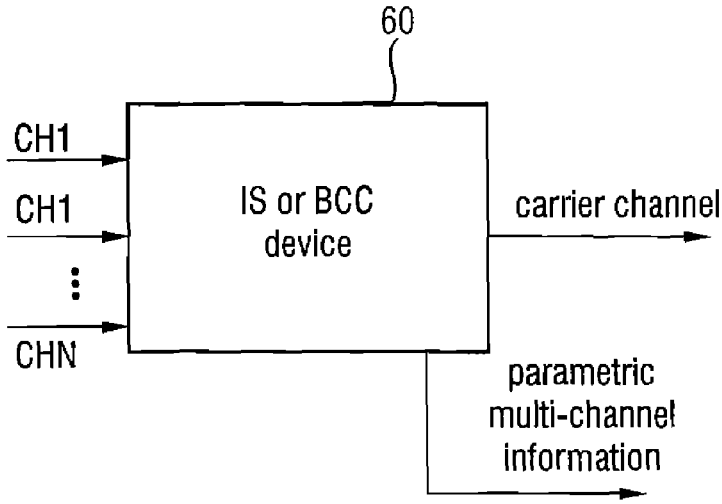
FIG. 3 shows a well-known joint stereo encoder for generating channel data and parametric multi-channel information.

There are several techniques for reducing the amount of data necessary for transmitting a multi-channel audio signal. Such techniques are also called joint stereo techniques. For this purpose, reference is made to FIG. 3 showing a joint stereo device 60. This device may be a device implementing, for example, the intensity stereo (IS) technique or the binaural cue encoding technique (BCC). Such a device generally receives at least two channels CH1, CH2, . . . , CHn as input signal and outputs a single carrier channel and parametric multi-channel information. The parametric data are defined so that an approximation of an original channel (CH1, CH2, . . . , CHn) may be calculated in a decoder.

Normally, the carrier channel will include subband samples, spectral coefficients, time domain samples, etc., which provide a relatively fine representation of the underlying signal, whereas the parametric data do not include such samples or spectral coefficients, but control parameters for controlling a certain reconstruction algorithm, such as, for example, weighting by multiplication, time shifting, frequency shifting, etc. The parametric multi-channel information thus includes a relatively rough representation of the signal or the associated channel. Expressed in numbers, the amount of data necessary for a carrier channel is in the range of 60 to 70 kbits/s, whereas the amount of data necessary for parametric side information for a channel is in the range from 1.5 to 2.5 kbits/sec. It is to be mentioned that the above numbers apply to compressed data. A non-compressed CD channel of course necessitates approximately tenfold data rates. An example of parametric data are the known scale factors, intensity stereo information or BCC parameters, as will be described below.

The intensity stereo encoding technique is described in the AES Preprint 3799 entitled "Intensity Stereo Coding" by J. Herre, K. H. Brandenburg, D. Lederer, February 1994, Amsterdam. In general, the concept of intensity stereo is based on a main axis transform which is to be applied to data of the two stereophonic audio channels. If most data points are concentrated around the first main axis, an encoding gain may be achieved by rotating both signals by a certain angle before encoding takes place. However, this does not apply to real stereophonic reproduction techniques. Thus, this technique is modified in that the second orthogonal component is excluded from being transmitted in the bitstream. Thus, the reconstructed signals for the left and right channels consist of differently weighted or scaled versions of the same transmitted signal. Nevertheless, the reconstructed signals differ in amplitude, but they are identical with respect to their phase information. The energy time envelopes of both original audio channels, however, are maintained by means of the selective scaling operation typically operating in a frequency-selective manner. This corresponds to human sound perception at high frequencies where the dominant spatial information is determined by the energy envelopes.

In addition, in practical implementations, the transmitted signal, i.e. the carrier channel, is produced from the sum signal of the left channel and the right channel instead of rotating both components. Additionally, this processing, i.e. generating intensity stereo parameters for performing the scaling operations, is performed in a frequency-selective manner, i.e. independently for each scale factor band, i.e. for each encoder frequency partition. Advantageously, both channels are combined to form a combined or "carrier" channel and, in addition to the combined channel, the intensity stereo information. The intensity stereo information depends on the energy of the first channel, the energy of the second channel or the energy of the combined channel.

The BCC technique is described in the AES Convention Paper 5574 entitled "Binaural Cue Coding applied to stereo and multichannel audio compression" by T. Faller, F. Baumgarte, May 2002, Munich. In BCC encoding, a number of audio input channels are converted to a spectral representation using a DFT-based transform with overlapping windows. The resulting spectrum is divided into non-overlapping portions, of which each has an index. Each partition has a bandwidth which is proportional to the equivalent right-angled bandwidth (ERB). The inter-channel level differences (ICLD) and the inter-channel time differences (ICTD) are determined for each partition and for each frame k. The ICLD and ICTD are quantized and encoded to finally reach a BCC bitstream as side information. The inter-channel level differences and the inter-channel time differences are given for each channel with regard to a reference channel. Then, the parameters are calculated according to predetermined formulae depending on the particular partitions of the signal to be processed.

On the decoder side, the decoder typically receives a mono-signal and the BCC bitstream. The mono-signal is transformed to the frequency domain and input into a spatial synthesis block which also receives decoded ICLD and ICTD values. In the spatial synthesis block, the BCC parameters (ICLD and ICTD) are used to perform a weighting operation of the mono-signal, to synthesize the multi-channel signals which, after a frequency/time conversion, represent a reconstruction of the original multi-channel audio signal.

In the case of BCC, the joint stereo module 60 is operative to output the channel-side information such that the parametric channel data are quantized and encoded ICLD or ICTD parameters, wherein one of the original channels is used as a reference channel for encoding the channel-side information.

Normally, the carrier signal is formed of the sum of the participating original channels.

The above techniques of course only provide a mono-representation for a decoder which can only process the carrier channel, but which is not able to process parametric data for generating one or several approximations of more than one input channel.

The BCC technique is also described in the US patent publication US 2003/0219130 A1, US 2003/0026441 A1 and US 2003/0035553 A1. Additionally, reference is made to the expert publication "Binaural Cue Coding. Part II: Schemes and Applications" by T. Faller and F. Baumgarte, IEEE Trans. On Audio and Speech Proc., Vol. 11, No. 6, November 2003.

Figure 4:
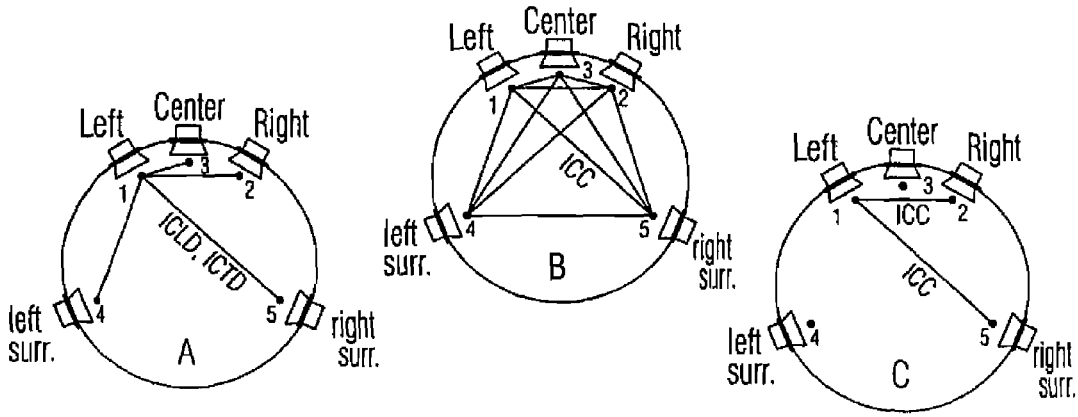
FIG. 4 is an illustration of a scheme for determining ICLD, ICTD and ICC parameters for BCC encoding/decoding.

Subsequently, a typical BCC scheme for multi-channel audio encoding will be illustrated in greater detail referring to FIGS. 4 to 6.

Figure 5:
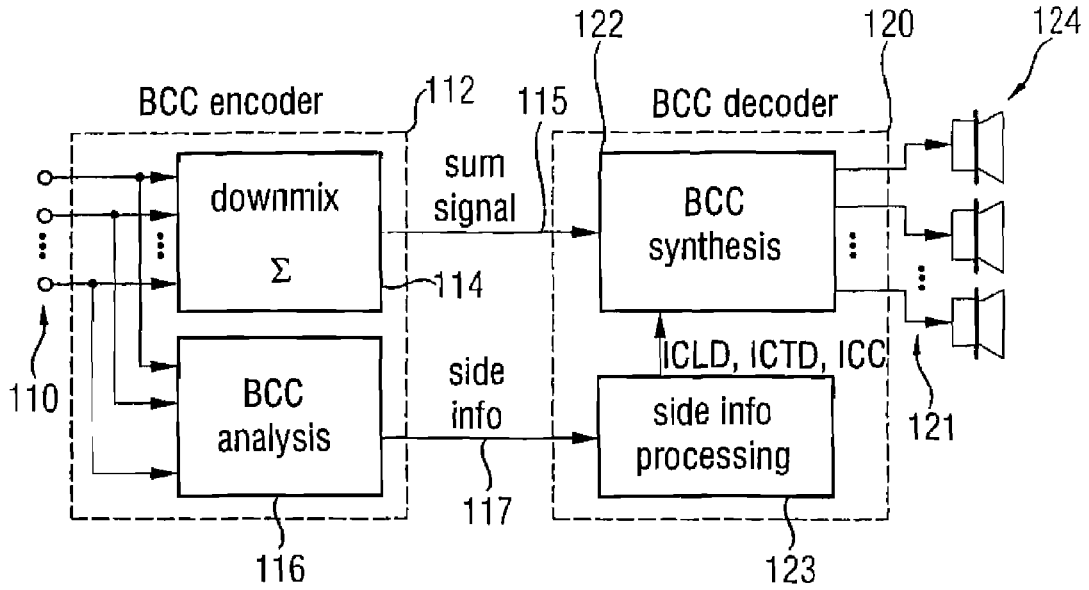
FIG. 5 is a block diagram illustration of a BCC encoder/decoder chain.

FIG. 5 shows such a BCC scheme for encoding/transmitting multi-channel audio signals. The multi-channel audio input signal at an input 110 of a BCC encoder 112 is mixed down in a so-called downmix block 114. With this example, the original multi-channel signal at the input 110 is a 5-channel surround signal having a front-left channel, a front-right channel, a left surround channel, a right surround channel and a center channel. In the embodiment of the present invention, the downmix block 114 generates a sum signal by means of a simple addition of these five channels into one mono-signal.

Other downmix schemes are known in the art, so that using a multi-channel input signal, a downmix channel having a single channel is obtained.

This single channel is output on a sum signal line 115. Side information obtained from the BCC analysis block 116 is output on a side-information line 117.

Inter-channel level differences (ICLD) and inter-channel time differences (ICTD) are calculated in the BCC analysis block, as has been illustrated above. Now, the BCC analysis block 116 is also able to calculate inter-channel correlation values (ICC values). The sum signal and the side information are transmitted to a BCC decoder 120 in a quantized and encoded format. The BCC decoder splits the transmitted sum signal into a number of subbands and performs scalings, delays and further processing steps to provide the subbands of the multi-channel audio channels to be output. This processing is performed such that the ICLD, ICTD and ICC parameters (cues) of a reconstructed multi-channel signal at the output 121 match the corresponding cues for the original multi-channel signal at the input 110 in the BCC encoder 112. For this purpose, the BCC decoder 120 includes a BCC synthesis block 122 and a side information-processing block 123.

Subsequently, the internal setup of the BCC synthesis block 122 will be illustrated referring to FIG. 6. The sum signal on the line 115 is supplied to a time/frequency conversion unit or filter bank FB 125. At the output of block 125, there is a number N of subband signals or, in an extreme case, a block of spectral coefficients when the audio filter bank 125 performs a 1:1 transformation, i.e. a transformation generating N spectral coefficients from N time domain samples.

The BCC synthesis block 122 further includes a delay stage 126, a level modification stage 127, a correlation processing stage 128 and an inverse filter bank stage IFB 129. At the output of stage 129, the reconstructed multi-channel audio signal having, for example, five channels in the case of a 5-channel surround system, may be output to a set of loudspeakers 124, as are illustrated in FIG. 5 or FIG. 4.

The input signal sn is converted to the frequency domain or the filter bank domain by means of the element 125. The signal output by the element 125 is copied such that several versions of the same signal are obtained, as is illustrated by the copy node 130. The number of versions of the original signal equals the number of output channels in the output signal. Then, each version of the original signal at the node 130 is subjected to a certain delay $d_1, d_2, \ldots, d_i, \ldots, d_N$. The delay parameters are calculated by the side information-processing block 123 in FIG. 5 and derived from the inter-channel time differences as they were calculated by the BCC analysis block 116 of FIG. 5.

The same applies to the multiplication parameters $a_1, a_2, \ldots, a_i, \ldots, a_N$, which are also calculated by the side information-processing block 123 based on the inter-channel level differences as they were calculated by the BCC analysis block 116.

The ICC parameters calculated by the BCC analysis block 116 are used for controlling the functionality of block 128 so that certain correlations between the delayed and level-manipulated signals are obtained at the outputs of block 128. It is to be noted here that the order of the stages 126, 127, 128 may differ from the order shown in FIG. 6.

Figure 6:
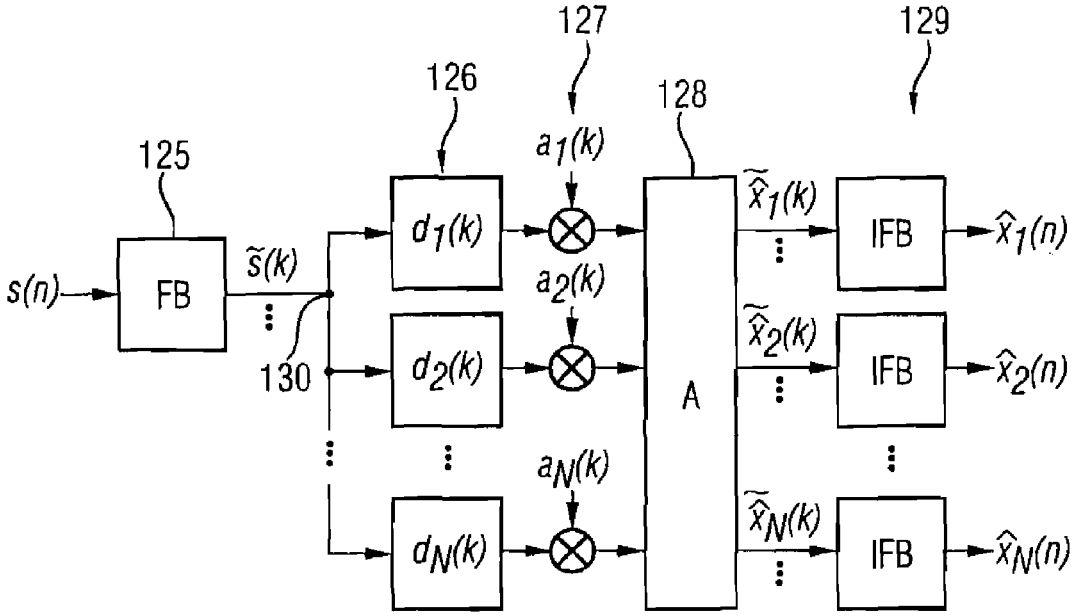
FIG. 6 shows a block diagram of an implementation of the BCC synthesis block of FIG. 5.

It is also to be noted that in a frame-wise processing of the audio signal, the BCC analysis is also performed frame-wise, i.e. temporally variable, and that further a frequency-wise BCC analysis is obtained, as can be seen by the filter bank division of FIG. 6. This means that the BCC parameters are obtained for each spectral band. This also means that in the case that the audio filter bank 125 breaks down the input signal into, for example, 32 band-pass signals, the BCC analysis block obtains a set of BCC parameters for each of the 32 bands. Of course, the BCC synthesis block 122 of FIG. 5, which is illustrated in greater detail in FIG. 6, also performs a reconstruction which is also based on the exemplarily mentioned 32 bands.

Subsequently, a scenario used for determining individual BCC parameters will be illustrated referring to FIG. 4. Normally, the ICLD, ICTD and ICC parameters may be defined between channel pairs. It is, however, of advantage for the ICLD and ICTD parameters to be determined between a reference channel and each other channel. This is illustrated in FIG. 4A.

ICC parameters may be defined in different manners. In general, ICC parameters may be determined in the encoder between all possible channel pairs, as is illustrated in FIG. 4B. There has been the suggestion to calculate only ICC parameters between the two strongest channels at any time, as is illustrated in FIG. 4C, which shows an example in which, at any time, an ICC parameter between the channels 1 and 2 is calculated and, at another time, an ICC parameter between the channels 1 and 5 is calculated. The decoder then synthesizes the inter-channel correlation between the strongest channels in the decoder and uses certain heuristic rules for calculating and synthesizing the inter-channel coherence for the remaining channel pairs.

With respect to the calculation of, for example, the multiplication parameters $a_1$, $a_N$ based on the transmitted ICLD parameters, reference is made to the AES Convention Paper No. 5574. The ICLD parameters represent an energy distribution of an original multi-channel signal. Without loss of generality, it is of advantage, as is shown in FIG. 4A, to take 4 ICLD parameters representing the energy difference between the respective channels and the front-left channel. In the side information-processing block 122, the multiplication parameters $a_1, \ldots, a_N$ are derived from the ICLD parameters so that the total energy of all reconstructed output channels is the same (or proportional to the energy of the sum signal transmitted).

In the embodiment shown in FIG. 7, the frequency/time conversion obtained by the inverse filter banks IFB 129 of FIG. 6 is dispensed with. Instead, the spectral representations of the individual channels at the input of these inverse filter banks are used and supplied to the headphone signal-processing device of FIG. 7 to perform the evaluation of the individual multi-channels with the respective two filters per multi-channel without an additional frequency/time transformation.

With regard to a complete processing taking place in the frequency domain, it is to be noted that in this case the multi-channel decoder, i.e., for example, the filter bank 125 of FIG. 6, and the stereo encoder should have the same time/frequency resolution. Additionally, it is of advantage to use one and the same filter bank, which is particularly of advantage in that only a single filter bank is necessary for the entire processing, as is illustrated in FIG. 1. In this case, the result is a particularly efficient processing since the transformations in the multi-channel decoder and the stereo encoder need not be calculated.

The input data and output data, respectively, in the inventive concept are thus encoded in the frequency domain by means of transformation/filter bank and are encoded under psycho-acoustic guidelines using masking effects, wherein in particular in the decoder there should be a spectral representation of the signals. Examples of this are MP3 files, AAC files or AC3 files. However, the input data and output data, respectively, may also be encoded by forming the sum and difference, as is the case in so-called matrixed processes. Examples of this are Dolby ProLogic, Logic7 or Circle Surround. The data of, in particular, the multi-channel representation may additionally be encoded by means of parametric methods, as is the case in MP3 surround, wherein this method is based on the BCC technique.

Depending on the circumstances, the inventive method for generating may be implemented in either hardware or software. The implementation may be on a digital storage medium, in particular on a disc or CD having control signals which can be read out electronically, which can cooperate with a programmable computer system such that the method will be executed. In general, the invention also is in a computer program product having a program encode stored on a machine-readable carrier for performing an inventive method when the computer program product runs on a computer. Put differently, the invention may also be realized as a computer program having a program encode for performing the method when the computer program runs on a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A device for generating an encoded stereo signal of an audio piece or an audio datastream comprising a first stereo channel and a second stereo channel from a multi-channel representation of the audio piece or the audio datastream comprising information on more than two multi-channels, comprising:

a provider configured to provide the more than two multi-channels from the multi-channel representation;

a performer configured to perform headphone signal processing to generate an uncoded stereo signal with an uncoded first stereo channel and an uncoded second stereo channel, the performer being configured to:

evaluate each multi-channel by a first filter function derived from a virtual position of a loudspeaker for reproducing the multi-channel and a virtual first ear position of a listener, for the first stereo channel, and a second filter function derived from a virtual position of the loudspeaker and a virtual second ear position of the listener, for the second stereo channel, to generate a first evaluated channel and a second evaluated channel for each multi-channel, the two virtual ear positions of the listener being different, add the evaluated first channels to obtain the uncoded first stereo channel, and add the evaluated second channels to obtain the uncoded second stereo channel; and a stereo encoder configured to encode the uncoded first stereo channel and the uncoded second stereo channel to obtain the encoded stereo signal, the stereo encoder being formed such that a data rate necessary for transmitting the encoded stereo signal is smaller than a data rate necessary for transmitting the uncoded stereo signal; wherein the multi-channel representation comprises one or several basic channels as well as parametric information for calculating each multi-channel from the one or several basic channels;

the provider is configured to calculate each multi-channel from the one or the several basic channels and the parametric information;

the provider is configured to provide, on an output side of the provider, a block-wise frequency domain representation for each multi-channel;

the performer is configured to evaluate the block-wise frequency domain representation for each multi-channel by a frequency domain representation of the first and second filter functions without a frequency domain to time domain conversion;

the performer is configured to generate a block-wise frequency domain representation of the uncoded first stereo channel and the uncoded second stereo channel; and the stereo encoder is a transformation-based encoder and is configured to process the block-wise frequency domain representation of the uncoded first stereo channel and the uncoded second stereo channel without a frequency domain to time domain conversion.

2. The device according to claim 1, wherein the performer is configured to use the first filter function considering direct sound, reflections and diffuse reverberation the second filter function considering direct sound, reflections and diffuse reverberation.

3. The device according to claim 2, wherein the first and the second filter functions correspond to a filter impulse response comprising a peak at a first time value representing the direct sound, several smaller peaks at second time values representing the reflections, each of the second time values being greater than the first time value, and a continuous region no longer resolved for individual peaks and representing the diffuse reverberation for third time values, each of the third time values being greater than a greatest time value of the second time values.

4. The device according to claim 1, wherein the stereo encoder is configured to perform a common stereo encoding of the first and second stereo channels.

5. The device according to claim 1, wherein the stereo encoder is configured to quantize a block of spectral values using a psycho-acoustic masking threshold and subject it to entropy encoding to obtain the encoded stereo signal.

6. The device according to claim 1, wherein the provider is formed as a BCC decoder.

7. The device according to claim 1, wherein the provider is a multi-channel decoder comprising a filter bank comprising several outputs, wherein the performer is configured to evaluate signals at the filter bank outputs by the first and second filter functions, and wherein the stereo encoder is configured to quantize the uncoded first stereo channel in the frequency domain and the uncoded second stereo channel in the frequency domain and subject it to entropy encoding to obtain the encoded stereo signal.

8. A method for generating an encoded stereo signal of an audio piece or an audio datastream comprising a first stereo channel and a second stereo channel from a multi-channel representation of the audio piece or the audio datastream comprising information on more than two multi-channels, comprising:

providing the more than two multi-channels from the multi-channel representation;

performing headphone signal processing to generate an uncoded stereo signal with an uncoded first stereo channel and an uncoded second stereo channel, the step of performing comprising:

evaluating each multi-channel by a first filter function derived from a virtual position of a loudspeaker for reproducing the multi-channel and a virtual first ear position of a listener, for the first stereo channel, and a second filter function derived from a virtual position of the loudspeaker and a virtual second ear position of the listener, for the second stereo channel, to generate a first evaluated channel and a second evaluated channel for each multi-channel, the two virtual ear positions of the listener being different, adding the evaluated first channels to obtain the uncoded first stereo channel, and adding the evaluated second channels to obtain the uncoded second stereo channel; and stereo-coding the uncoded first stereo channel and the uncoded second stereo channel to obtain the encoded stereo signal, the step of stereo-coding being executed such that a data rate necessary for transmitting the encoded stereo signal is smaller than a data rate necessary for transmitting the uncoded stereo signal; wherein the multi-channel representation comprises one or several basic channels as well as parametric information for calculating each multi-channel from the one or several basic channels;

each multi-channel is calculated from the one or the several basic channels and the parametric information;

as a result of the step of providing, a block-wise frequency domain representation for each multi-channel is obtained;

the step of performing includes evaluating the block-wise frequency domain representation for each multi-channel by a frequency domain representation of the first and second filter functions without a frequency domain to time domain conversion;

the step of performing includes generating a block-wise frequency domain representation of the uncoded first stereo channel and the uncoded second stereo channel; and the step of stereo-coding includes using a transformation-based encoder and processing the block-wise frequency domain representation of the uncoded first stereo channel and the uncoded second stereo channel without a frequency domain to time domain conversion.

9. A non-transitory storage medium having stored thereon a computer program comprising a program code for performing a method when the computer program runs on a computer for generating an encoded stereo signal of an audio piece or an audio datastream comprising a first stereo channel and a second stereo channel from a multi-channel representation of the audio piece or the audio datastream comprising information on more than two multi-channels, comprising:

providing the more than two multi-channels from the multi-channel representation;

performing headphone signal processing to generate an uncoded stereo signal with an uncoded first stereo channel and an uncoded second stereo channel, the step of performing comprising:

evaluating each multi-channel by a first filter function derived from a virtual position of a loudspeaker for reproducing the multi-channel and a virtual first ear position of a listener, for the first stereo channel, and a second filter function derived from a virtual position of the loudspeaker and a virtual second ear position of the listener, for the second stereo channel, to generate a first evaluated channel and a second evaluated channel for each multi-channel, the two virtual ear positions of the listener being different, adding the evaluated first channels to obtain the uncoded first stereo channel, and adding the evaluated second channels to obtain the uncoded second stereo channel; and stereo-coding the uncoded first stereo channel and the uncoded second stereo channel to obtain the encoded stereo signal, the step of stereo-coding being executed such that a data rate necessary for transmitting the encoded stereo signal is smaller than a data rate necessary for transmitting the uncoded stereo signal; wherein the multi-channel representation comprises one or several basic channels as well as parametric information for calculating each multi-channel from the one or several basic channels;

each multi-channel is calculated from the one or the several basic channels and the parametric information;

as a result of the step of providing, a block-wise frequency domain representation for each multi-channel is obtained;

the step of performing includes evaluating the block-wise frequency domain representation for each multi-channel by a frequency domain representation of the first and second filter functions without a frequency domain to time domain conversion;

the step of performing includes generating a block-wise frequency domain representation of the uncoded first stereo channel and the uncoded second stereo channel; and the step of stereo-coding includes using a transformation-based encoder and processing the block-wise frequency domain representation of the uncoded first stereo channel and the uncoded second stereo channel without a frequency domain to time domain conversion.

* * * * *